US008361249B2

(12) United States Patent
Shimoyama et al.

(10) Patent No.: US 8,361,249 B2
(45) Date of Patent: Jan. 29, 2013

(54) HIGH-STRENGTH STEEL PLATE RESISTANT TO STRENGTH REDUCTION RESULTING FROM STRESS RELIEF ANNEALING AND EXCELLENT IN WELDABILITY

(75) Inventors: Satoshi Shimoyama, Kakogawa (JP); Hiroki Imamura, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 675 days.

(21) Appl. No.: 11/935,560

(22) Filed: Nov. 6, 2007

(65) Prior Publication Data

US 2008/0145263 A1 Jun. 19, 2008

(30) Foreign Application Priority Data

Dec. 15, 2006 (JP) ..... 2006-338933

(51) Int. Cl.
*C22C 38/44* (2006.01)

(52) U.S. Cl. ..... 148/335; 148/320; 420/109

(58) Field of Classification Search ..... 148/320, 148/328, 330, 332–336; 420/8, 84, 89–93, 420/104–106, 108–112, 119, 123, 121, 124, 420/126, 127; *C22C 38/22*
See application file for complete search history.

(56) References Cited

U.S. PATENT DOCUMENTS

| | | | | |
|---|---|---|---|---|
| 5,454,883 | A | 10/1995 | Yoshie et al. | |
| 6,331,216 | B1 * | 12/2001 | Toyooka et al. | 148/320 |
| 2008/0283158 | A1 | 11/2008 | Nagao et al. | |

FOREIGN PATENT DOCUMENTS

| | | | |
|---|---|---|---|
| CA | 2 549 867 | | 1/2006 |
| CA | 2 602 728 | | 10/2006 |
| CN | 1106070 | | 8/1995 |
| EP | 1 662 014 | | 5/2006 |
| JP | 54-110914 | | 8/1979 |
| JP | 57-116756 | | 7/1982 |
| JP | 57-120652 | | 7/1982 |
| JP | 59-153867 | | 9/1984 |
| JP | 63-089627 | | 2/1988 |
| JP | 7-188837 | | 7/1995 |
| JP | 10-195591 | * | 7/1998 |
| JP | 11-140584 | * | 5/1999 |
| JP | 11-181546 | | 7/1999 |
| JP | 2001-64726 | | 3/2001 |
| JP | 2001-64727 | | 3/2001 |

(Continued)

*Primary Examiner* — Scott Kastler
*Assistant Examiner* — Vanessa Luk
(74) *Attorney, Agent, or Firm* — Oblon, Spivak, McClelland, Maier & Neustadt, L.L.P.

(57) ABSTRACT

A steel plate has a C content between 0.05 to 0.18% by mass (hereinafter, content will be expressed simply in "%"), a Si content between 0.10 to 0.50%, a Mn content between 1.2 to 2.0%, an Al content between 0.01 to 0.10%, a Cr content between 0.05 to 0.30% and a V content between 0.01 to 0.05%, and meets a condition expressed by expression (1).

$$6.7[Cr]+4.5[Mn]+3.5[V] \geqq 7.2\% \quad (1)$$

where [Cr], [Mn] and [V] represent a Cr content, a Mn content and a V content in percent by mass, respectively. The strength reduction of the steel sheet is small even if the steel sheet is subjected for a long time to a stress relief annealing process after being processed by welding. Cracks do not form in the steel plate when the steel plate is welded.

15 Claims, 2 Drawing Sheets

FOREIGN PATENT DOCUMENTS

| | | | |
|---|---|---|---|
| JP | 2002-241837 | * | 8/2002 |
| JP | 2004-269964 | | 9/2004 |
| KR | 10-2006-0128999 | | 12/2006 |
| WO | 98/38345 | | 9/1998 |
| WO | 99/05335 | | 2/1999 |
| WO | WO 2006/104261 | A1 | 10/2006 |

* cited by examiner

HIGH-STRENGTH STEEL PLATE RESISTANT TO STRENGTH REDUCTION RESULTING FROM STRESS RELIEF ANNEALING AND EXCELLENT IN WELDABILITY

BACKGROUND OF THE INVENTION

1. Field of the Invention

The present invention relates to a high-strength steel plate resistant to strength reduction when processed by a stress relief annealing process (hereinafter, referred to as "SR process") and resistant to cracking when processed by a welding process.

2. Description of the Related Art

Makers of large steel pressure vessels (tanks) are promoting on-site assembly of overseas tanks for cost reduction in recent years. It has been usual to complete a tank by carry out processes including a cutting process for cutting out steel workpieces, a shaping process for bending the steel workpieces, an assembling process for assembling the steel workpieces by welding, a SR process (local heat treatment) for processing some of the steel workpieces, and a final assembling process at the maker's plant and to transport the completed tank to an installation site.

There is a trend, in view of improving efficiency, toward building a tank by carrying out processes for cutting out workpieces, bending the workpieces to produce component members in the maker's plant, transporting the component members, building a tank on site by assembling the component members by welding and processing the entire tank by an on-site SR process.

As the method of building a tank thus changes, time for which the SR process is continued and the number of cycles of the SR process need to be increased from the view point of on-site welding techniques and safety. A fact that the component members of a tank are subjected to a SR process for a time between about 20, and about 30, hr in total needs to be taken into consideration in designing materials.

It is known that carbide grains contained in a steel agglomerate in large carbide grains remarkably reducing the strength of the steel when the steel is subjected to a SR process for such a long time. It has been a usual practice to suppress strength reduction due to long SR process and to prevent the coarsening of cementite grains by adding Cr to steels.

However, addition of Cr to a steel in a high Cr content deteriorates the weldability of the steel and often causes weld cracks to form. Under such circumstances, it has been desired to develop a high-strength steel plate, as a useful material for forming tanks, capable of minimizing strength reduction to the least possible extent and of ensuring satisfactory weldability even when the high-strength steel plate is subjected to along SR process.

Usually, Cr—Mo steel plates are used as steel plates capable of minimizing strength reduction due to processing by a SR process to the least possible extent. Such a Cr—Mo steel plate contains Cr in a high Cr content to suppress strength reduction due to a SR process and contains Mo to improve high-temperature strength.

A technique proposed in, for example, JP-A S57-116756 provides a tough and hard steel for pressure vessels basically containing 0.26, to 0.75% Cr and 0.45, to 0.60% Mo. This technique adds Cr to the steel to suppress the coarsening of carbide grains due to a SR process and to suppress strength reduction due to a SR process, the idea of which is the same as the foregoing basic idea. However, the weldability of this tough and hard steel is unsatisfactory because the tough and hard steel has a high Cr content.

A technique proposed in JP-A S57-120652, provides a high-strength steel for pressure vessels basically containing 0.10, to 1.00% Cr and 0.45, to 0.60% Mo. This technique intends to suppress the coarsening of $Fe_3C$ grains into large $M_{23}C_6$, grains due to processing by a long SR process by adding Cr. However, only high-strength steels having a Cr content of 0.29% or above are disclosed in JP-A S57-120652, and hence it is expected those high-strength steels are unsatisfactory in weldability.

SUMMARY OF THE INVENTION

The present invention has been made under such circumstances and it is therefore an object of the present invention to provide a high-strength steel plate not significantly subject to strength reduction due to a long stress relief annealing process following a welding process, i.e., resistant to strength reduction attributable to a long stress relief annealing process, excellent in weldability, and resistant to weld cracking when processed by a welding process.

An aspect of the present invention is directed to a steel plate having a C content between 0.05, to 0.18% by mass (hereinafter, content will be expressed simply in "%"), a Si content between 0.10, to 0.50%, a Mn content between 1.2, to 2.0%, an Al content between 0.01, to 0.1%, a Cr content between 0.05 to 0.30% and a V content between 0.01, to 0.05%, and meeting a condition expressed by:

$$6.7[Cr]+4.5[Mn]+3.5[V] \geqq 7.2\% \quad (1)$$

where [Cr], [Mn] and [V] represent a Cr content, a Mn content and a V content in percent by mass, respectively.

The mean circle-equivalent diameter of cementite grains contained in the steel plate is 0.165 μm or below.

The term "circle-equivalent diameter" signifies the diameter of a circle of an area equal to that of a cementite grain.

According to the aspect of the present invention, when necessary, the steel plate may contain, in addition to the foregoing basic elements, other elements in (a) a Cu content between 0.05, and 0.8% and/or a Ni content between 0.05, and 1%, (b) a Mo content between 0.01, and 0.3%, (c) a Nb content between 0.005, and 0.05%, (d) a Ti content between 0.005, and 0.05%, (e) a B content between 0.0005, and 0.01% or (f) a Ca content between 0.0005, and 0.005%. Those elements improve the properties of the steel plate still further.

According to the aspect of the present invention, the chemical composition of the steel plate is controlled so as to meet the condition expressed by Expression (1) to make the steel plate contain small cementite grains. Thus the strength reduction in the steel plate due to a SR process can be suppressed, and the steel plate is excellent in weldability and is a useful material for forming tanks.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

The inventors of the present invention made various studies of components of a steel plate effective in maintaining satisfactory weldability of the steel plate without causing strength reduction when the steel plate is subjected to a long SR process. It was found through the studies that the grain size of cementite grains contained in a steel plate can be reduced and strength reduction can be minimized by properly controlling the chemical composition of the steel plate and controlling the Cr, the Mn and the V content of the steel plate so as to meet the condition expressed by Expression (1) and the present invention has been made on the basis of those findings. Expression (1) was derived from the following circumstances.

A strength enhancing method known as a precipitation strength enhancing method is based on a fact that dislocation is obstructed by the dislocation pinning effect of precipitates when many precipitates are dispersed in the matrix. It can be inferred from this idea that considerable strength reduction occurs if cementite grains grow large.

Generally, when a solute is soluble in cementite in a high solubility, the rate of coarsening of cementite grains is determined by the diffusion coefficient of the solute instead of the diffusion coefficient of C. An element having a high solubility with cementite and having a small diffusion coefficient as compared with that of C is Cr. Elements similar in characteristic to Cr are Mn and V.

The inventors of the present invention conducted experiments to examined the respective cementite grain coarsening suppressing effects of Cr, Mn and V when Cr, Mn and V are added individually to a steel and found that the cementite grain coarsening suppressing effect of Cr, Mn and V is maximized when a steel contains Cr, Mn and V so as to meet a condition expressed by:

$$6.7[Cr]+4.5[Mn]+3.5[V] \geqq 7.2\% \quad (1)$$

where [Cr], [Mn] and [V] represent a Cr content, a Mn content and a V content in percent by mass, respectively.

Figure 1:
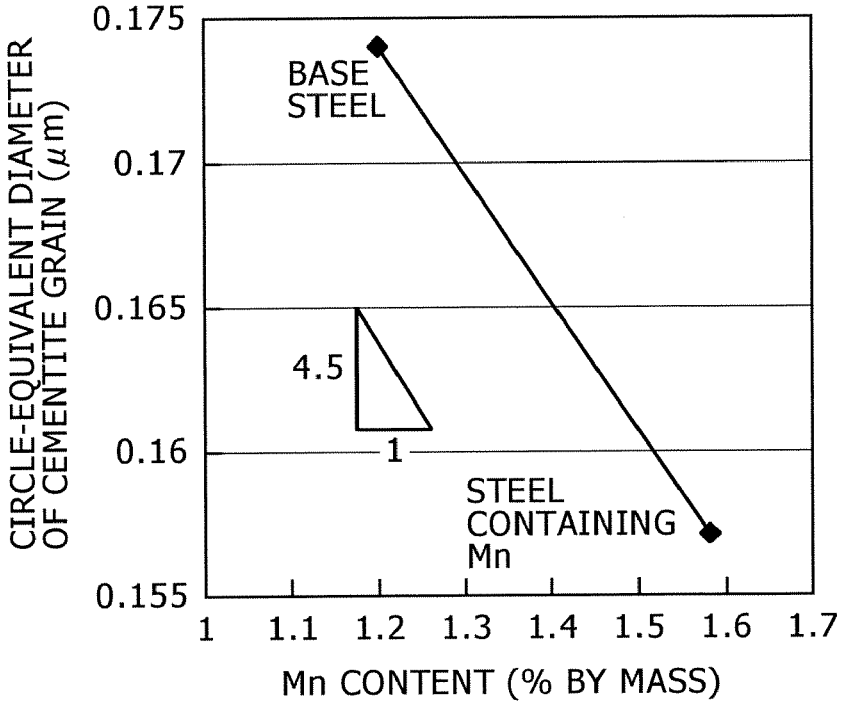
FIG. 1 is a graph showing the dependence of the circle-equivalent diameter of cementite grains on Mn content.

Expression (1) was deduced by the following procedure. FIG. 1 is a graph showing the dependence of the circle-equivalent diameter of cementite grains on Mn content by way of example. In FIG. 1, Mn content is measured on the horizontal axis and the circle-equivalent diameter of cementite grains is measured on the vertical axis.

It was determined from the inclination of a straight line shown in FIG. 1 that a coefficient indicating the effect of a unit amount of Mn on the circle-equivalent diameter of cementite grains was 4.5. Similarly, coefficients indicating the respective effects of a unit amount of Cr and a unit amount of V, respectively, on the circle-equivalent diameter of cementite grains were determined. The coefficients of Expression (1) were thus determined.

Figure 2:
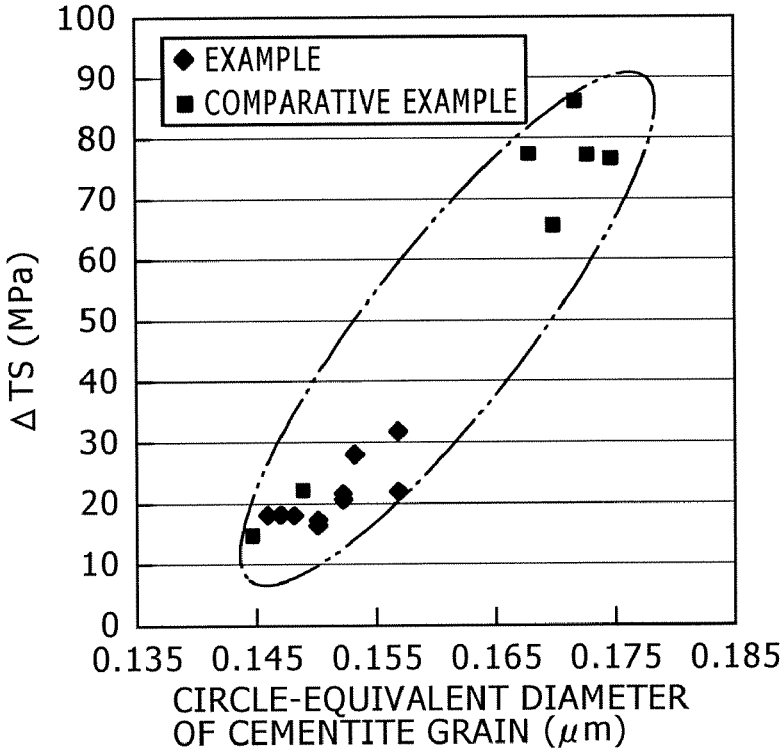
FIG. 2 is a graph showing the dependence of strength reduction ΔTS on the circle-equivalent diameter of cementite grains.

The inventors of the present invention found through studies that the circle-equivalent diameter of cementite grains and the strength of the steel plate are highly correlative with each other. FIG. 2 is a graph showing the dependence of strength reduction ΔTS caused by a SR process on the circle-equivalent diameter of cementite grains. It is obvious from FIG. 2 that the coarsening of cementite grains (circle-equivalent diameter) has an effect on strength reduction.

Figure 3:
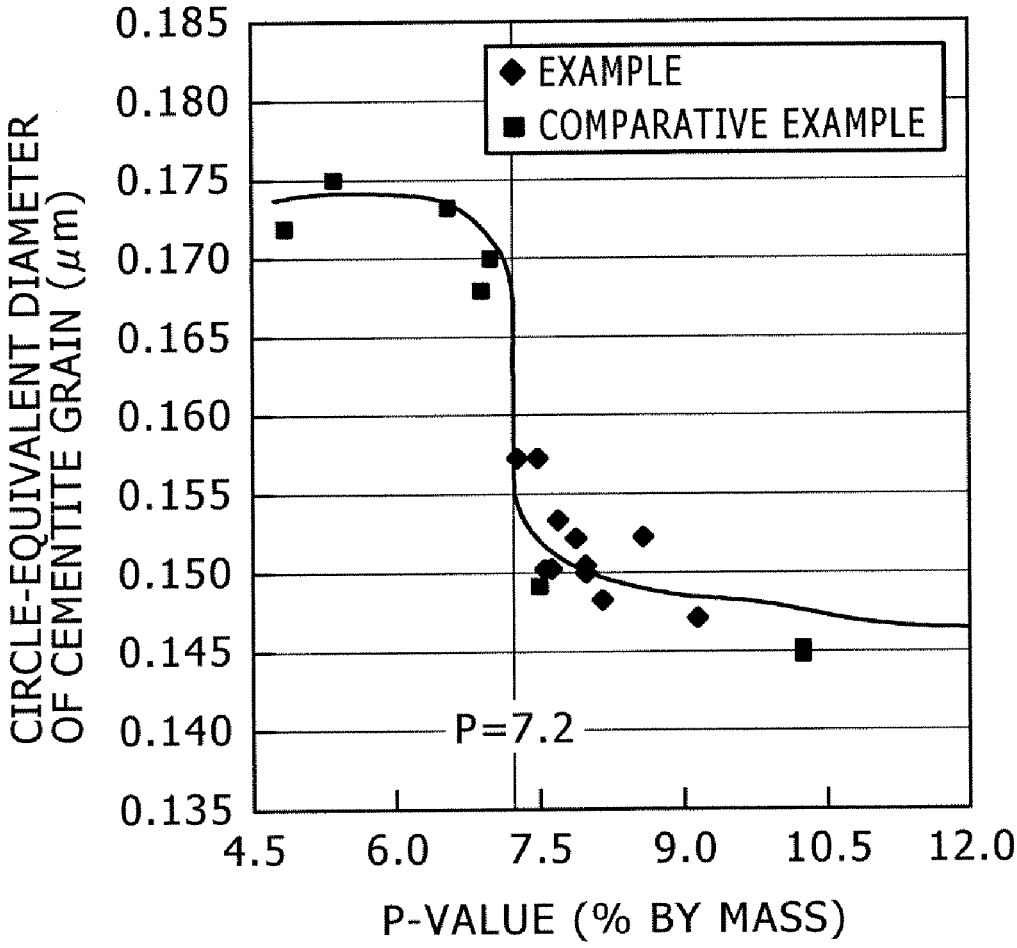
FIG. 3 is a graph showing the variation of the circle-equivalent diameter of cementite grains with P-value.

The inventors of the present invention produced steel plates respectively having different compositions to change the value of the left side of Expression (1), namely, 6.7[Cr]+4.5[Mn]+3.5[V] (this value will be called "P-value"), between 5.0, and 11.0, to determine the relation between the circle-equivalent diameter of cementite grains and strength reduction ΔTS. FIG. 3 is a graph showing the variation of the circle-equivalent diameter of cementite grains with P-value. It is known from FIG. 3 that the greater the P-value, the higher the cementite grain coarsening suppressing effect, and the curve indicating the variation of the circle-equivalent diameter of cementite grains has an inflection point at a P-value of 7.2. When the P-value, namely the value of the left side of Expression (1) is 7.2, or above, cementite can be dispersed in fine cementite grains having grain sizes of 0.165 μm or below.

A high-strength steel plate of the present invention needs to contain Cr, Mn and V so as to need the condition expressed by Expression (1), and to contain basic components including Cr, Mn, V, C, Si and Al in contents in proper ranges respectively. Ranges for those contents of the steel plate are as follows.

C Content: 0.05, to 0.18%

C is an important element for improving the hardenability of the steel plate and to enhance the strength and toughness of the steel plate. The C content of the steel plate needs to be 0.05% or above to make C exhibit such effects. Although a high C content is desirable from the viewpoint of enhancing strength, an excessively high C content reduces the toughness of weld zones of the steel plate. A desirable C content needs to be 0.18% or below. A preferable C content range is between 0.06% and 0.16%.

Si Content: 0.10, to 0.50%

Silicon (Si) is an effective deoxidizer when a steel is molten. The Si content of the steel plate needs to be 0.10% or above to make Si exhibit such an effect. However, an excessively high Si content reduces the toughness of the steel plate. A desirable Si content needs to be 0.50% or below. A preferable Si content is between 0.15% and 0.35%.

Mn Content: 1.2, to 2.0%

Manganese (Mn) is an essential element for improving the hardenability, strength and toughness of the steel plate and has high solubility with cementite next to Cr. Manganese (Mn) dissolved in cementite effectively suppresses the coagulation and coarsening of cementite grains. To make Mn exhibit those effect, the Mn content of the steel plate needs to be 1.2% or above. Excessively high Mn content reduces the toughness of weld zones. An upper limit of Mn content is 2.0%. Preferably, the Mn content is between 1.30, and 1.8%. Further preferably, an upper limit of Mn content is 1.7%.

Al Content: 0.01, to 0.1%

Aluminum (Al) serves as a deoxidizer. The effect of Al is insufficient when the Al content is below 0.01%. When the Al content is excessively high, the toughness of the steel plate is reduced and crystal grains grow large. Therefore, the upper limit of Al content is 0.1%. Preferably, the Al content is between 0.02, and 0.8%.

Cr Content: 0.05, to 0.30%

Chromium (Cr), similarly to Mn, is an element effective in improving the hardenability, strength and toughness of the steel plate even if it is added to the steel plate in a low Cr content. Similarly to Mn, Cr dissolved in cementite effectively suppresses the coagulation and coarsening of cementite grains. To make Cr exhibit those effect, the Cr content of the steel plate needs to be 0.05% or above. Excessively high Cr content affects adversely to weldability. The Cr content should be 0.30% or below. Preferably, the Cr content is between 0.10, and 0.25%. Further preferably, an upper limit of Cr content is 0.22%.

V Content: 0.01, to 0.05%

Similarly to Mn and Cr, V has high solubility with cementite and is an effective element in suppressing the coarsening of cementite grains. Vanadium (V) is an element indispensable to promoting the growth of minute carbonitride grains, improving the strength of the steel plate, making it possible to reduce the necessary amounts of other elements capable of improving hardenability, and improving weldability (resistance to weld cracking) without reducing the strength. To make V exhibit those effects, the V content of the steel plate needs to be 0.01% or above. Excessively high V content exceeding 0.05% reduces the toughness of heat affected zones (HAZ). Preferably, the V content is between 0.02, and 0.04%. Further preferably, an upper limit of V content is 0.03%.

The foregoing elements are the basic components of the high-strength steel plate of the present invention and others are Fe and inevitable impurities. The inevitable impurities include P, N, S and O contained in steel materials or those that can mix in steel materials during steel manufacturing processes. Among those impurities, P and S reduce weldability and reduce toughness after a SR process. Preferably, the P content is 0.01% or below and S content is 0.01% or below.

It is desirable that the steel plate of the present invention contain, when necessary, in addition to the foregoing basic elements, other elements in (a) a Cu content between 0.05 and 0.8% and/or a Ni content between 0.05, and 1%, (b) a Mo content between 0.01, and 0.3%, (c) a Nb content between 0.005, and 0.05%, (d) a Ti content between 0.005, and 0.05%, (e) a B content between 0.0005, and 0.01% or (f) a Ca content between 0.0005, and 0.005%. Ranges for those contents of the steel plate are as follows.

Cu Content: 0.005, to 0.8% and/or Ni Content: 0.05, to 1%

Copper (Cu) and Ni are elements effective in improving the hardenability of the steel plate. Each of the Cu content and the Ni content of the steel plate needs to be 0.05% or above to make Cu and Ni exhibit such an effect. The foregoing effect saturates at some Cu or Ni content. Preferably, the Cu and the Ni content are 0.8% or below and 1% or below respectively, desirably, 0.5% or below and 0.8% or below, respectively.

Mo Content: 0.01, to 0.3%

Molybdenum (Mo) is effective in maintaining the strength of the steel plate when the steel plate is subjected to an annealing process. The effect of Mo is effective when the Mo content is 0.01% or above. The effect of Mo saturates at some Mo content. Preferably, the Mo content is 0.3% or below, more desirably, 0.2% or below.

Nb Content: 0.005, to 0.05%

Similarly to V, Nb contributes to promoting the growth of minute carbonitride grains and improving the strength of the steel plate. To make Nb exhibit those effects, a preferable Nb content is 0.005% or above. Excessively high Nb content exceeding 0.05% reduces the HAZ toughness. Preferably, an upper limit of Nb content is 0.05%.

Ti Content: 0.0005, to 0.05%

Titanium (Ti) contained even in a low Ti content in the steel plate is effective in improving HAZ toughness. Such an effect of Ti is effective when the Ti content is 0.005% or above. An excessively high Ti content exceeding 0.05% causes the reduction of the toughness of the steel plate.

B Content: 0.0005, to 0.01%

Boron (B) effectively improves the hardenability of the steel plate even if the B content is very low. To make such an effect of B effective, the B content is 0.0005% or above. An excessively high B content exceeding 0.01% reduces the toughness of the steel plate.

Ca Content: 0.0005, to 0.005%

Calcium (Ca) is effective in controlling inclusions to improve the toughness of the steel plate. Such an effect of Ca is effective when the Ca content is 0.0005% or above. Since the effect of Ca saturates at some Ca content, it is preferable that the Ca content is 0.005% or below.

In the steel plate having the foregoing chemical composition and meeting the condition expressed by Expression (1), the mean grain size of cementite grains is 0.165, μm or below. Consequently, the reduction of the strength of the steel plate due to a SR process can be suppressed. Although the steel plate can be manufactured by an ordinary steel plate manufacturing method, the following steel plate manufacturing methods (1) to (3) (hot rolling conditions and heat treatment conditions) are preferable for obtaining fine cementites. Preferable process conditions for the steel plate manufacturing methods (1) to (3) will be described.

Steel Plate Manufacturing Method (1)

A slab is produced by casting a molten ingot steel having properly adjusted chemical composition by a continuous casting machine. The slab heated at a temperature between about 1000 and 1200° C. is subjected to a rolling process and the rolling process is completed at a temperature not lower than the $Ar_3$ transformation temperature to obtain a steel plate. The steel plate is cooled by natural cooling. Then, the steel plate is heated again and is subjected to a hardening process. Then, the steel plate is subjected to a tempering process that heats the steel plate at a temperature between 600, and 700° C.

Steel Plate Manufacturing Method (2)

A steel plate manufacturing method (2), similarly to the steel plate manufacturing method (1), produces a slab, heats the slab subjects the slab to a rolling process, and completes the rolling process at a temperature not lower than the $Ar_3$ transformation temperature to obtain a steel plate. Then, the steel plate is cooled at a cooling rate of 4° C./s or above.

Steel Plate Manufacturing Method (3)

A steel plate manufacturing method (3), similarly to the steel plate manufacturing method (2), produces a slab, heats the slab subjects the slab to a rolling process, completes the rolling process at a temperature not lower than the $Ar_3$ transformation temperature and cools the steel plate at a cooling rate of 4° C./s or above. Then the steel plate is subjected to a tempering process that heats the steel plate at a temperature between 600, and 700° C.

In any one of those steel plate manufacturing methods, it is preferable to heat the slab at a heating temperature between 1000, and 1200° C. Temperatures below 1000° C. are not high enough to produce a satisfactory single-phase austenitic structure. Abnormal grain growth occurs in some cases when the heating temperature exceeds 1200° C. The rolling process is completed at a temperature not lower than the $Ar_3$, transformation temperature to complete the rolling process in a temperature range in which ferrite does not start forming.

After the rolling process (hot rolling process) has been completed, the steel plate is cooled by natural cooling and is heated again at a temperature not lower than the $Ar_3$ transformation temperature by a hardening process (steel plate manufacturing method (1)) or the steel plate is cooled at a cooling rate of 4° C./s or above (steel plate manufacturing methods (2) and (3)). Those processes are carried out to suppress ferrite formation. Ferrite forms and the strength is reduced remarkably if the rolling process is completed at a temperature below the $Ar_3$, transformation temperature or the cooling rate is below 4° C./s.

The steel plate manufacturing method includes a tempering process in case of need like the steel plate manufacturing methods (2) and (3). The steel plate is subjected to a tempering process to adjust the properties thereof properly. The strength of the steel plate is excessively high if the tempering temperature is below 600° C. and is excessively low if the tempering temperature is above 700° C.

Minute cementite grains are dispersed in the high-strength steel plate thus manufactured. Therefore, the reduction of the strength due to a SR process can be suppressed to the least extent, weld cracking rarely occurs in the high-strength steel plate, and the high-strength steel plate is excellent in weldability and is a very useful material for forming large steel vessels.

EXAMPLES

Steel plates conforming to conditions specified by the present invention will be described by way of example.

Slabs were produced by casting molten ingot steels respectively having chemical compositions shown in Table 1. The slabs were subjected to a hot rolling process, and a heat treatment (hardening and tempering processes) under process conditions shown in Table 2, to obtain steel plates. The steel plates of steel qualities B and C were subjected directly to a hardening process after hot rolling under the conditions shown in Table 2. The steel plates of steel qualities other than the steel qualities B and C were subjected to a hardening process at about 930° C. after hot rolling, water-cooled at cooling rates shown in Table 2,, and then air-cooled at temperatures not higher than 200° C.

The cooling rates shown in Table 2, are the mean cooling rates with respect to a direction parallel to the thickness. The heating temperature is the temperature of a part of the steel plate at t/4, (t is thickness) from the surface in a temperature distribution between the opposite surfaces of the steel plate calculated by a process computer on the basis of temperatures in a furnace in a period between the start of heating and the end of heating, and a time for which the steel plate is held in the furnace.

The $Ac_3$, transformation temperatures and the $Ar_3$ transformation temperatures of the steel qualities shown in Table 1, were determined by calculation using Expressions (2) and (3).

$$Ac_3 = 908 - 223.7[C] + 438.5[P] + 30.49[Si] + 37.92[V] - 34.43[Mn] - 23[Ni] \quad (2)$$

$$Ar_3 = 910 - 310[C] - 80[Mn] - 20[Cu] - 15[Cr] - 55[Ni] - 80[Mo] + 0.35(t - 8) \quad (3)$$

Note that respective figures before elements in parentheses of [ ] shows elemental contents (percent by mass) and that "t" means the abbreviation of thickness (mm) of a steel plate.

TABLE 1

| Quality | Chemical composition (% by mass) | | | | | | | | | | | | | | | P-value | $Ac_3$ transformation temperature | $Ar_3$ transformation temperature |
|---|---|---|---|---|---|---|---|---|---|---|---|---|---|---|---|---|---|---|
| | C | Si | Mn | P | S | Al | Cu | Ni | Cr | Mo | V | Nb | Ti | B | Ca | | | |
| A | 0.13 | 0.25 | 1.46 | 0.007 | 0.003 | 0.030 | — | — | 0.20 | — | 0.025 | — | — | — | — | 7.9 | 840 | 751 |
| B | 0.10 | 0.25 | 1.35 | 0.007 | 0.003 | 0.030 | — | — | 0.20 | — | 0.025 | — | — | — | — | 7.4 | 851 | 779 |
| C | 0.09 | 0.25 | 1.40 | 0.007 | 0.003 | 0.030 | — | — | 0.20 | — | 0.025 | — | — | — | — | 7.7 | 851 | 782 |
| D | 0.17 | 0.12 | 1.26 | 0.006 | 0.003 | 0.021 | — | — | 0.22 | — | 0.048 | 0.02 | 0.015 | — | 0.0020 | 7.3 | 836 | 761 |
| E | 0.09 | 0.48 | 1.70 | 0.006 | 0.003 | 0.050 | 0.10 | 0.35 | 0.13 | 0.05 | 0.022 | 0.02 | — | 0.0015 | 0.0020 | 8.5 | 839 | 725 |
| F | 0.13 | 0.10 | 1.35 | 0.005 | 0.005 | 0.051 | — | 0.10 | 0.26 | 0.05 | 0.025 | — | 0.015 | — | — | 7.8 | 836 | 755 |
| G | 0.06 | 0.25 | 1.95 | 0.006 | 0.002 | 0.030 | — | 0.40 | 0.06 | 0.05 | 0.013 | — | 0.015 | 0.0015 | — | 9.1 | 829 | 728 |
| H | 0.10 | 0.11 | 1.48 | 0.005 | 0.004 | 0.012 | 0.10 | 0.20 | 0.22 | 0.05 | 0.020 | — | 0.015 | — | — | 8.1 | 836 | 755 |
| I | 0.05 | 0.12 | 1.56 | 0.006 | 0.002 | 0.030 | 0.40 | 0.68 | 0.08 | 0.09 | 0.020 | — | 0.015 | — | — | 7.5 | 836 | 750 |
| J | 0.11 | 0.25 | 1.23 | 0.006 | 0.002 | 0.032 | — | — | 0.29 | 0.05 | 0.025 | — | — | 0.0001 | — | 7.5 | 852 | 784 |
| K | 0.14 | 0.25 | 1.50 | 0.004 | 0.003 | 0.030 | — | 0.15 | 0.04 | — | 0.020 | — | — | 0.015 | — | 7.0 | 832 | 744 |
| L | 0.17 | 0.15 | 1.18 | 0.005 | 0.004 | — | 0.10 | 0.20 | 0.02 | 0.05 | — | — | 0.015 | — | — | 5.4 | 832 | 753 |
| M | 0.14 | 0.35 | 1.20 | 0.005 | 0.003 | 0.030 | — | 0.20 | 0.32 | 0.07 | — | — | 0.015 | 0.0055 | — | 7.5 | 844 | 756 |
| N | 0.04 | 0.48 | 1.55 | 0.005 | 0.003 | 0.030 | — | 0.40 | 0.49 | — | 0.023 | — | 0.015 | 0.0100 | — | 10.3 | 853 | 758 |
| O | 0.18 | 0.25 | 0.65 | 0.005 | 0.003 | — | — | — | 0.55 | — | — | — | 0.015 | 0.0015 | — | 6.6 | 855 | 814 |
| P | 0.18 | 0.10 | 0.90 | 0.007 | 0.002 | 0.021 | — | 0.40 | 0.12 | 0.06 | 0.015 | 0.05 | — | — | — | 4.9 | 834 | 761 |
| Q | 0.13 | 0.15 | 1.25 | 0.005 | 0.003 | 0.030 | — | 0.20 | 0.20 | 0.05 | — | — | 0.015 | 0.0010 | — | 6.9 | 839 | 768 |

Other elements: Fe and inevitable impurities excluding P and S

TABLE 2

| Exp. No. | Quality | Slab heating temperature (° C.) | Rolling conditions: Rolling completion temperature (° C.) | Rolling conditions: Cooling ending temperature (° C.) | Rolling conditions: Cooling rate (° C./s) | Rolling conditions: Cooling method | Conditions for heat treatment: Hardening temperature (° C.) | Conditions for heat treatment: Cooling rate (° C./s) | Conditions for heat treatment: Tempering temperature (° C.) |
|---|---|---|---|---|---|---|---|---|---|
| 1 | A | 1080 | 878 | — | — | Air cooling | 929 | 70 | 650 |
| 2 | B | 1086 | 800 | 150 | 28 | Water cooling | — | — | — |
| 3 | C | 1068 | 790 | 120 | 12 | Water cooling | — | — | 650 |
| 4 | D | 1072 | 860 | — | — | Air cooling | 928 | 18 | 650 |
| 5 | E | 1080 | 857 | — | — | Air cooling | 931 | 18 | 630 |
| 6 | F | 1081 | 861 | — | — | Air cooling | 926 | 13 | 660 |
| 7 | G | 1083 | 858 | — | — | Air cooling | 927 | 4.2 | 630 |
| 8 | H | 1077 | 868 | — | — | Air cooling | 928 | 5.9 | 650 |

TABLE 2-continued

| Exp. No. | Quality | Slab heating temperature (° C.) | Rolling conditions: Rolling completion temperature (° C.) | Rolling conditions: Cooling ending temperature (° C.) | Rolling conditions: Cooling rate (° C./s) | Rolling conditions: Cooling method | Conditions for heat treatment: Hardening temperature (° C.) | Conditions for heat treatment: Cooling rate (° C./s) | Conditions for heat treatment: Tempering temperature (° C.) |
|---|---|---|---|---|---|---|---|---|---|
| 9 | I | 1058 | 879 | — | — | Air cooling | 925 | 1.9 | 660 |
| 10 | J | 1082 | 860 | — | — | Air cooling | 930 | 5.5 | 650 |
| 11 | K | 1100 | 882 | — | — | Air cooling | 926 | 18 | 650 |
| 12 | L | 1086 | 888 | — | — | Air cooling | 928 | 13 | 650 |
| 13 | M | 1085 | 857 | — | — | Air cooling | 929 | 6.4 | 630 |
| 14 | N | 1081 | 860 | — | — | Air cooling | 927 | 6.1 | 630 |
| 15 | O | 1080 | 885 | — | — | Air cooling | 926 | 4.1 | 670 |
| 16 | P | 1080 | 890 | — | — | Air cooling | 925 | 13 | 670 |
| 17 | Q | 1103 | 888 | — | — | Air cooling | 926 | 5.7 | 660 |

The circle-equivalent diameters of cementite grains in the steel plates obtained by the foregoing processes were measured by the following method. The weldability of the settle sheets was evaluated in terms of results of a y-type weld cracking test specified in Z3158,, JIS. Each of the steel plates was subjected to a SR process for 25, hr at 600° C. The tensile strength of each of the steel plates was measured by the following tensile strength test method before and after the SR process. A strength reduction ΔTS caused by the SR process was calculated.

[Circle-equivalent Diameter Measuring Method]

Ten parts of about 200, μm in a part of each steel plate at a depth of t/4, (t is thickness) were observed at a 7500× magnification through a transmission electron microscope. Image data on those ten parts was analyzed to determine a circle-equivalent diameter of a cementite grain from an area per cementite grain calculated on the basis of the area ratio and number of cementite grains. The circle-equivalent diameter is the diameter of a circle having an area equal to that of a section of a cementite grain. Images of cementite grains of a sectional area not greater than 0.0005, $\mu m^2$, were considered to be noise and were omitted.

[Conditions for y-type Weld Cracking Test]

Welding method: Shielded metal-arc welding

Heat input: 1.7, kJ/mm

Welding material: Z3212, D5816,, JIS

Atmospheric temperature: 20° C.

Humidity: 60%

Preheating temperature: 50° C.

[Tensile Test]

Specimens No. 4, specified in Z2201,, JIS of each steel plate were taken before and after the SR process from a part of the steel plate extending in a direction perpendicular to the rolling direction from a part at t/4, (t is thickness). Tensile strengths TS of the specimens taken respectively before and after the SR process were measured. The difference between the respective tensile strengths TS of the specimen not processed by the SR process and the specimen processed by the SR process, namely, strength reduction ΔTS, was calculated. Specimens having a strength reduction ΔTS below 40, MPa were decided to be satisfactory in SR characteristic.

Table 3, shows measured data on tensile strength TS before SR process, tensile strength TS after SR process, strength reduction ΔTS, weldability, and the thicknesses of the steel plates.

TABLE 3

| Exp. No. | Quality | TS before SR process (MPa) | TS after SR process (MPa) | ΔTS (MPa) | Grain size of cementite grains (μm) | Thickness (mm) | Weldability |
|---|---|---|---|---|---|---|---|
| 1 | A | 553 | 536 | 17 | 0.150 | 12 | No crack formed (Preheating: 50° C.) |
| 2 | B | 600 | 568 | 32 | 0.157 | 40 | No crack formed (Preheating: 50° C.) |
| 3 | C | 580 | 552 | 28 | 0.153 | 50 | No crack formed (Preheating: 50° C.) |
| 4 | D | 573 | 552 | 21 | 0.157 | 25 | No crack formed (Preheating: 50° C.) |
| 5 | E | 601 | 580 | 21 | 0.152 | 25 | No crack formed (Preheating: 50° C.) |
| 6 | F | 579 | 558 | 21 | 0.152 | 30 | No crack formed (Preheating: 50° C.) |
| 7 | G | 587 | 569 | 18 | 0.147 | 65 | No crack formed (Preheating: 50° C.) |
| 8 | H | 565 | 547 | 18 | 0.148 | 50 | No crack formed (Preheating: 50° C.) |
| 9 | I | 545 | 528 | 17 | 0.150 | 100 | No crack formed (Preheating: 50° C.) |
| 10 | J | 496 | 485 | 11 | 0.150 | 50 | No crack formed (Preheating: 50° C.) |
| 11 | K | 542 | 476 | 65 | 0.170 | 25 | No crack formed (Preheating: 50° C.) |
| 12 | L | 520 | 444 | 76 | 0.175 | 30 | No crack formed (Preheating: 50° C.) |
| 13 | M | 576 | 554 | 22 | 0.149 | 25 | Cracks formed (Preheating: 50° C.) |
| 14 | N | 578 | 564 | 14 | 0.145 | 50 | Cracks formed (Preheating: 50° C.) |
| 15 | O | 516 | 439 | 77 | 0.173 | 65 | Cracks formed (Preheating: 50° C.) |
| 16 | P | 511 | 424 | 87 | 0.172 | 30 | No crack formed (Preheating: 50° C.) |
| 17 | Q | 515 | 438 | 77 | 0.168 | 50 | No crack formed (Preheating: 50° C.) |

The following conclusions were made from the results of the tests. (As for the experimental Nos. below, please refer to Tables 2, and 3.) The respective chemical compositions of the steel plates processed under conditions for Experiments Nos. 1, to 10, met the condition expressed by Expression (1). Minute cementite grains each having a small circle-equivalent diameter were dispersed in those steel plates and the respective strength reductions ΔTS of those steel plates were small.

The steel plates processed under conditions for Experiments Nos. 11, 12, and 15, to 17, contained some of Mn, Cr and V, which are very important elements for the present invention, in a Mn, a Cr or a V content outside the content rage specified by the present invention and had P-values below 7.2. Sizes of cementite grains contained in those steel plates were greater than 0.165, μm. The strength reduction ΔTS of each of those steel plates was large.

Each of the steel plates processed under conditions for Experiments Nos. 13, and 14, had a Cr content greater than the maximum Cr content specified by the present invention. Each of those steel plates had a P-value not smaller than 7.2. The grows of cementite grains in those steel plates, similarly to that of cementite grains in the steel plates processed under the conditions for Experiments Nos. 1, to 10,, was suppressed (FIG. 3). However, cracks formed in those steel plates during weld cracking test using a preheating temperature of 50° C. The weld cracking test proved that an excessively high Cr content deteriorated weldability.

FIG. 2 is a graph showing the relation between strength reduction ΔTS and circle-equivalent diameter of cementite grains determined on the basis of the measured data, and FIG. 3 is a graph showing the relation between P-value and circle-equivalent diameter determined on the basis of the measured data.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A steel plate having a composition consisting of: by mass in %, a C content of from 0.05 to 0.18%, a Si content of from 0.10 to 0.50%, a Mn content of from 1.2 to 2.0%, an Al content of from 0.01 to 0.10%, a Cr content of from 0.10 to 0.22%, a P content of 0.01% or below, a S content of 0.01% or below, a V content of from 0.02 to 0.03%, optionally Cu,
optionally Ni,
optionally Mo,
optionally Ti,
optionally B, and
optionally Ca, wherein the remaining balance of the composition is Fe and inevitable impurities, wherein the composition satisfies a condition expressed by:

$$6.7[Cr]+4.5[Mn]+3.5[V]\geqq 7.2\% \quad (1)$$

where [Cr], [Mn] and [V] represent the Cr content, the Mn content and the V content in percent by mass, respectively, and wherein cementite grains in the steel plate have a mean grain size equal to a circle-equivalent diameter of from 0.147 to 0.165 μm, and wherein the steel is made by a process comprising heating a steel slab having the composition of the steel plate at a temperature of from 1000 to 1200° C.; hot rolling and cooling the steel slab at a cooling rate of 4° C./s or above to form the steel plate; and tempering the steel plate at a temperature of from 600 to 700° C., wherein ferrite formation in the steel plate is suppressed during the process.

2. The steel plate according to claim 1, wherein Cu is present in a Cu content of from 0.05 to 0.8% by mass.

3. The steel plate according to claim 2, wherein Ni is present in a Ni content of from 0.05 to 1% by mass.

4. The steel plate according to claim 1, wherein Mo is present in a Mo content of from 0.01 to 0.3%.

5. The steel plate according to claim 1, wherein Ti is present in a Ti content of from 0.005 to 0.05% by mass.

6. The steel plate according to claim 1, wherein B is present in a B content of from 0.0005 to 0.01% by mass.

7. The steel plate according to claim 1, wherein Ca is present in a Ca content of from 0.0005 to 0.005% by mass.

8. The steel plate according to claim 1, wherein the cooling rate is in a range of from 4° C./s to 18° C./s.

9. The steel plate according to claim 1, wherein the Mn content is 1.2% or higher and less than 1.5%.

10. The steel plate according to claim 1, wherein the steel has a strength reduction of less than 40 MPa after a stress relief process.

11. The steel plate according to claim 1, wherein the composition consists of: by mass in %, a C content of from 0.06 to 0.16%, a Si content of from 0.10 to 0.50%, a Mn content of from 1.2 to 2.0%, an Al content of from 0.01 to 0.10%, a Cr content of from 0.10 to 0.22%, a P content of 0.01% or below, a S content of 0.01% or below, a V content of from 0.02 to 0.03%, optionally Cu,
optionally Ni,
optionally Mo,
optionally Ti,
optionally B, and
optionally Ca, wherein the remaining balance of the composition is Fe and inevitable impurities.

12. The steel plate according to claim 11, wherein the cementite grains in the steel plate have a mean grain size equal to a circle-equivalent diameter of from 0.147 to 0.157 μm.

13. The steel plate according to claim 1, wherein the cementite grains in the steel plate have a mean grain size equal to a circle-equivalent diameter of from 0.147 to 0.157 μm.

14. The steel plate according to claim 1, wherein Ni is present in a Ni content of from 0.05 to 1% by mass.

15. The steel plate according to claim 1, wherein:

when Cu is present it is present in a Cu content of from 0.05 to 0.8% by mass;

when Ni is present it is present in a Ni content of from 0.05 to 1% by mass;

when Mo is present it is present in a Mo content of from 0.01 to 0.3% by mass;

when Ti is present it is present in a Ti content of from 0.005 to 0.05% by mass;

when B is present it is present in a B content of from 0.0005 to 0.01% by mass; and when Ca is present it is present in a Ca content of from 0.0005 to 0.005% by mass.

* * * * *